US006833782B2

(12) United States Patent
Nguyen

(10) Patent No.: US 6,833,782 B2
(45) Date of Patent: Dec. 21, 2004

(54) BIMETAL SNAP DISC THERMOSTAT WITH HEATERS

(75) Inventor: Truong Nguyen, Wooster, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 10/613,160

(22) Filed: Jul. 3, 2003

(65) Prior Publication Data

US 2004/0066269 A1 Apr. 8, 2004

Related U.S. Application Data

(63) Continuation of application No. 09/580,845, filed on May 30, 2000, now Pat. No. 6,597,274.

(51) Int. Cl.[7] ..... H01H 37/14; H01H 37/52

(52) U.S. Cl. ..... 337/377; 337/381; 337/380

(58) Field of Search ..... 337/16, 102, 103, 337/104, 36, 53, 97, 298, 333, 343, 377, 390, 77, 100, 380, 381; 29/623, 622

(56) References Cited

U.S. PATENT DOCUMENTS

| | | | |
|---|---|---|---|
| 3,248,501 | A | 4/1966 | Hire |
| 3,870,985 | A | 3/1975 | Hire |
| 3,909,768 | A | 9/1975 | Woods |
| 4,037,316 | A | 7/1977 | Stoll |
| 4,533,894 | A | 8/1985 | Bishop et al. |
| 4,591,820 | A | 5/1986 | Ruszczyk et al. |
| 4,646,051 | A | 2/1987 | Ruszczyk et al. |
| 4,754,251 | A | 6/1988 | Ting et al. |
| 4,908,595 | A | 3/1990 | Niino |
| 5,576,683 | A | 11/1996 | Rose |
| 5,973,587 | A | 10/1999 | Hofsass |

FOREIGN PATENT DOCUMENTS

| | | | |
|---|---|---|---|
| DE | 4335639 | A1 | 10/1993 |

*Primary Examiner*—Anatoly Vortman
(74) *Attorney, Agent, or Firm*—Harness, Dickey & Pierce, P.L.C.

(57) ABSTRACT

An adjustable bimetal snap disc thermostat is disclosed which provides conventional resistance-type heaters symmetrically positioned adjacent one side of the snap disc to allow adjustment of the operating temperature of the thermostat. The heaters are supported in accurate, very close proximity to the bimetal snap disc to ensure excellent heat transfer thereto. Additionally, the volume of the chamber within which the heaters are supported is reduced by a bridge portion which also serves to further reinforce the outer housing walls. Additionally, guide surfaces for the heater terminals are provided to facilitate assembly.

11 Claims, 3 Drawing Sheets

BIMETAL SNAP DISC THERMOSTAT WITH HEATERS

This application is a continuation of U.S. patent application Ser. No. 09/580,845 filed on May 30, 2000 now U.S. Pat. No. 6,597,274. The disclosure of the above application is incorporated herein by reference.

BACKGROUND AND SUMMARY OF THE INVENTION

The present invention relates generally to bimetal snap disc thermostats and more particularly to an improved bimetal snap disc thermostat in which resistance heaters are employed to depress the ambient temperatures at which such thermostats are actuated.

Bimetal snap disc thermostats which provide an electrical resistance heater controlled by an external control circuit to change the operating temperature of the thermostat are known. An example of such a thermostat is illustrated and described in U.S. Pat. No. 3,248,501 (assigned to the assignee of the present invention), which patent is incorporated herein by reference. Such device includes an annular disc-shaped heater of special construction which is positioned adjacent to the snap disc. Because the disc heater is not a standard available heating device of general utility, it is relatively expensive to produce. Further, when the disc heater is installed in the thermostat, it must be subsequently connected to the terminals. Consequently, the thermostat in accordance with such patent is relatively expensive to produce and is also relatively expensive to assemble.

It is also known to provide strip heaters in combination with blade-type bimetal thermostats, as illustrated in U.S. Pat. No. 3,870,985. Here again, the heater is of a special construction, and therefore relatively expensive to produce.

More recently, however, bimetal snap disc thermostats have been developed which utilize conventional commercially available resistance type heaters. The use of such resistance type heaters is disclosed in U.S. Pat. No. 4,533,894 (assigned to the assignee of the present invention).

Additionally, U.S. Pat. No. 5,576,683 discloses a bimetal snap disc thermostat utilizing resistance heaters in which the resistance heaters are supported closely adjacent a bimetal snap disc by a separate thermal insulator member. In this thermostat, a thin sheet film member is required to ensure the resistance heaters are electrically insulated from the snap disc. While this thermostat provided greater temperature depression than the prior art thermostats, it required the manufacture and assembly of both the thermal insulator support as well as the sheet film insulator which resulted in increased costs. Further, the sheet film also tends to slightly thermally insulate the bimetal snap disc from the resistance heaters thus limiting the effective temperature depression that can be achieved.

It should also be noted that the size of air volume of the chamber within which the resistance heaters are located may adversely effect the efficiency of the resistance heaters in depressing the response temperature of the bimetal snap disc.

In one application, these bimetal snap action switches are utilized to control temperatures in clothes dryers. In such applications, it is increasingly desirable to provide such thermostats with the ability to offer greater and greater temperature depression capability in order to offer a wider range of drying temperatures. In previous efforts to accommodate this increased temperature depression, higher wattage resistance heaters have been required but in some cases, the increase wattage of the heaters has required the use of more costly ceramic housings as opposed to the less expensive phenolic switch cases. Because ceramic switch cases are significantly more fragile than the phenolic counterparts, it has been difficult, if not impossible, to manufacture such thermostats in an automated assembly line. This aspect also significantly increases the cost of such thermostats.

The bimetal snap disc thermostat of the present invention overcomes these disadvantages by providing a chamber to accommodate the resistors having a smaller volume and providing locating tabs to aid in more precisely positioning of the resistor heaters thereby enabling the elimination of the sheet film insulator between the heaters and the bimetal snap disc while still allowing the heaters to be positioned within close proximity to the bimetal snap disc. Also, the resistor heaters and their associated leads are entirely suspended in the chamber by the terminals to which the leads are secured thus providing an insulating air layer between the resistor heater body including its leads and the phenolic switch case. All of these modifications contribute to more efficient heat transfer from the heating resistors to the bimetal snap disc thus allowing greater temperature depression with lower wattage heating resistors while also enabling the use of phenolic switch case without exceeding its thermal limits. Additionally, the raised locating tabs serve an additional function of further strengthening the switch case thus reducing the possibility of damage thereto when the snap disc retainer is crimped into position. Additionally, the switch case includes guide surfaces operative to assist in assembly of the heating resistors and associated contacts during assembly.

Additional advantages and features of the present invention will become apparent from the subsequent description and the appended claims taken in conjunction with the accompanying drawings.

DESCRIPTION OF THE PREFERRED EMBODIMENT

Figure 1:
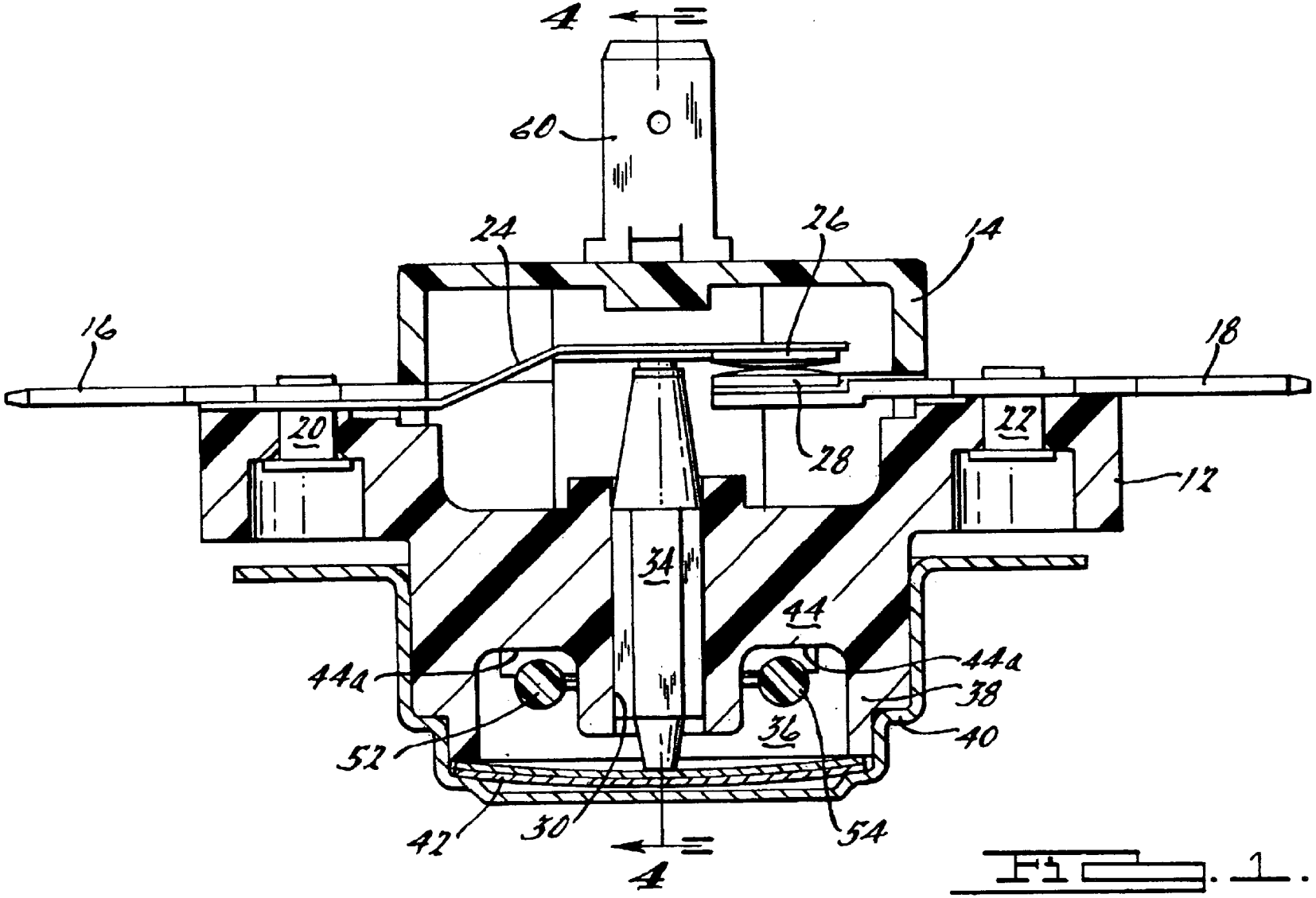
FIG. 1 is a section view of a bimetal snap disc thermostat in accordance with the present invention.

Referring now to the drawings, wherein the showings are for purposes of illustrating a preferred embodiment of the invention only and not for purposes of limiting same, FIG. 1 shows a thermostat 10 having a dielectric plastic housing that includes a housing base 12 and a cover 14. Switch terminals 16, 18 are attached to housing base 12 by rivets 20, 22. A movable spring blade 24 carries a movable switch contact 26 and is attached to both switch terminal 16 and housing base 12 by rivet 20. Switch terminal 18 carries a fixed switch contact 28.

Housing base 12 has a central elongated sleeve 30 which is supported within housing base 12 by means of a partition 31 with an internal passage 32 receiving a reciprocating plunger 34 aligned with springblade 24. An annular cavity 36 is defined between sleeve 30, partition 31 and housing base peripheral wall 38.

A metal disc cup 40 secured to housing base peripheral wall 38 supports a bimetal disc 42 that cooperates with reciprocating plunger 34 for opening and closing switch contacts 26, 28. When a predetermined elevated temperature is reached, disc 40 snaps from the position shown in FIG. 1 to an oppositely bowed position and moves plunger 34 upwardly to bend springblade 24 and move contact 26 away from fixed contact 28. When a predetermined lower temperature is reached, bimetal disc 40 will snap back to the bowed position shown in FIG. 1 and the spring force of switch arm 24 will move contact 26 back into engagement with contact 28.

Thermostatic switches of the type described are commonly provided with internal heaters for depressing the temperatures at which the bimetal disc snaps between switch open and switch closed positions. By way of example, say that a given thermostat snaps to a switch open position at an externally sensed temperature of about 150° F. and snaps back to a switch closed position at an externally sensed temperature of about 130° F. An existing arrangement allows depression of these temperatures as much as about 30° F. by adding internal heaters to the thermostat for heating the bimetal disc. With the heaters energized, the disc will snap to a switch open position at an external temperature of about 120° F. and will snap back to a switch closed position at an external temperature of about 100° F. Temperature depression greater than about 30° F. is not possible because the internal heaters necessary to produce the required heat would also cause the thermal limits of the thermostat housing to be exceeded unless a special high temperature resistant switch case material was used such as for example a ceramic switch case in lieu of the preferred phenolic switch case. Additionally, the volume of the chamber in which the heating resistors are positioned in prior art devices of this type tends to reduce the potential temperature depression that can be achieved with a given size resistor as well as to delay the response time.

Figure 2:
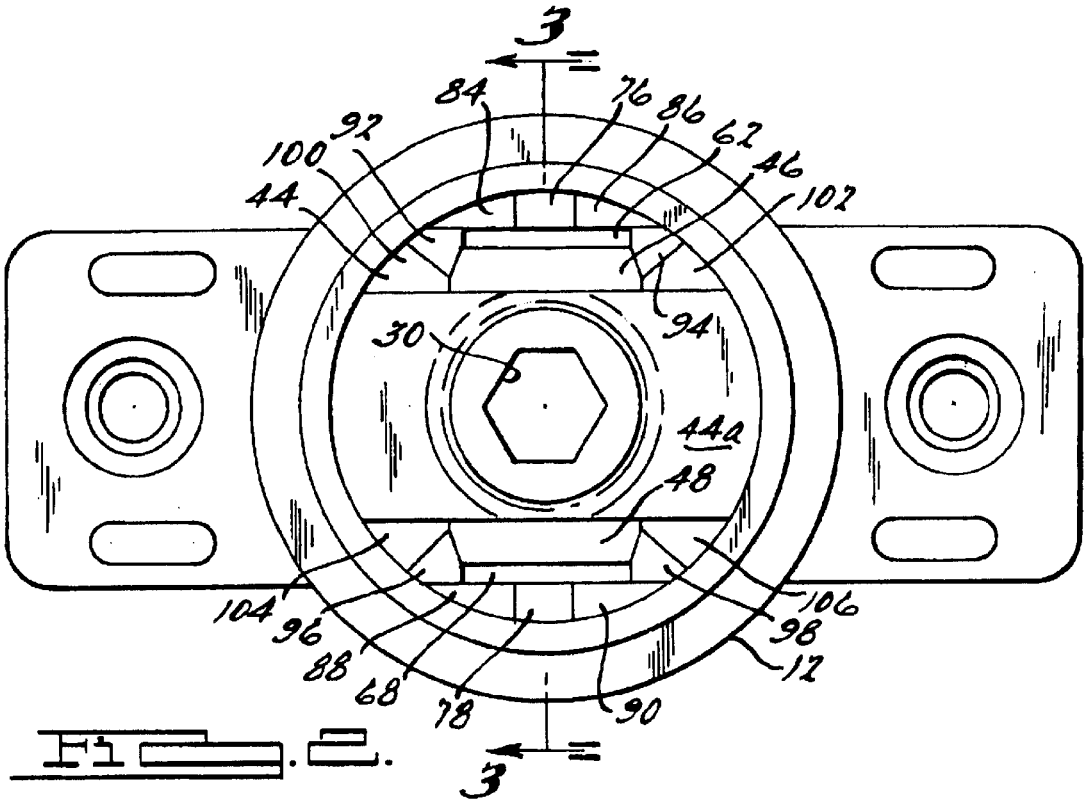
FIG. 2 is a bottom elevational view of the bimetal snap disc thermostat switch case shown in FIG. 1 with the heating resistors and associated contacts removed therefrom.
Figure 3:
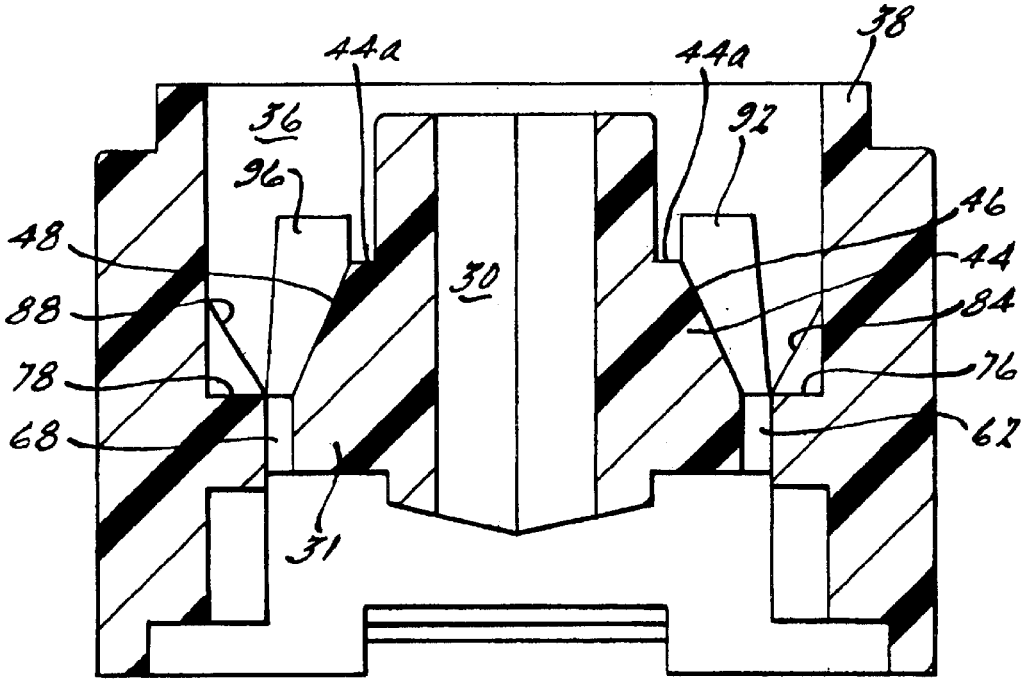
FIG. 3 is a section view of the switch case of FIG. 2, the section being taken along lines 3—3 thereof.

In the present invention, the volume of chamber 36 is reduced considerably by providing a diametrically extending bridge section 44 having a generally planar surface 44*a* integrally formed therewith, as best seen with reference to FIG. 2. As shown, bridge section 44 is defined by a pair of chord sidewalls 46 and 48 extending along opposite sides of sleeve 30 and spaced radially outward therefrom. Bridge section 44 is integrally formed with partition 31 and serves to substantially reduce the volume of chamber 36 as compared to the volume of the heater chamber provided in prior bimetal snap action thermostats.

Figure 4:
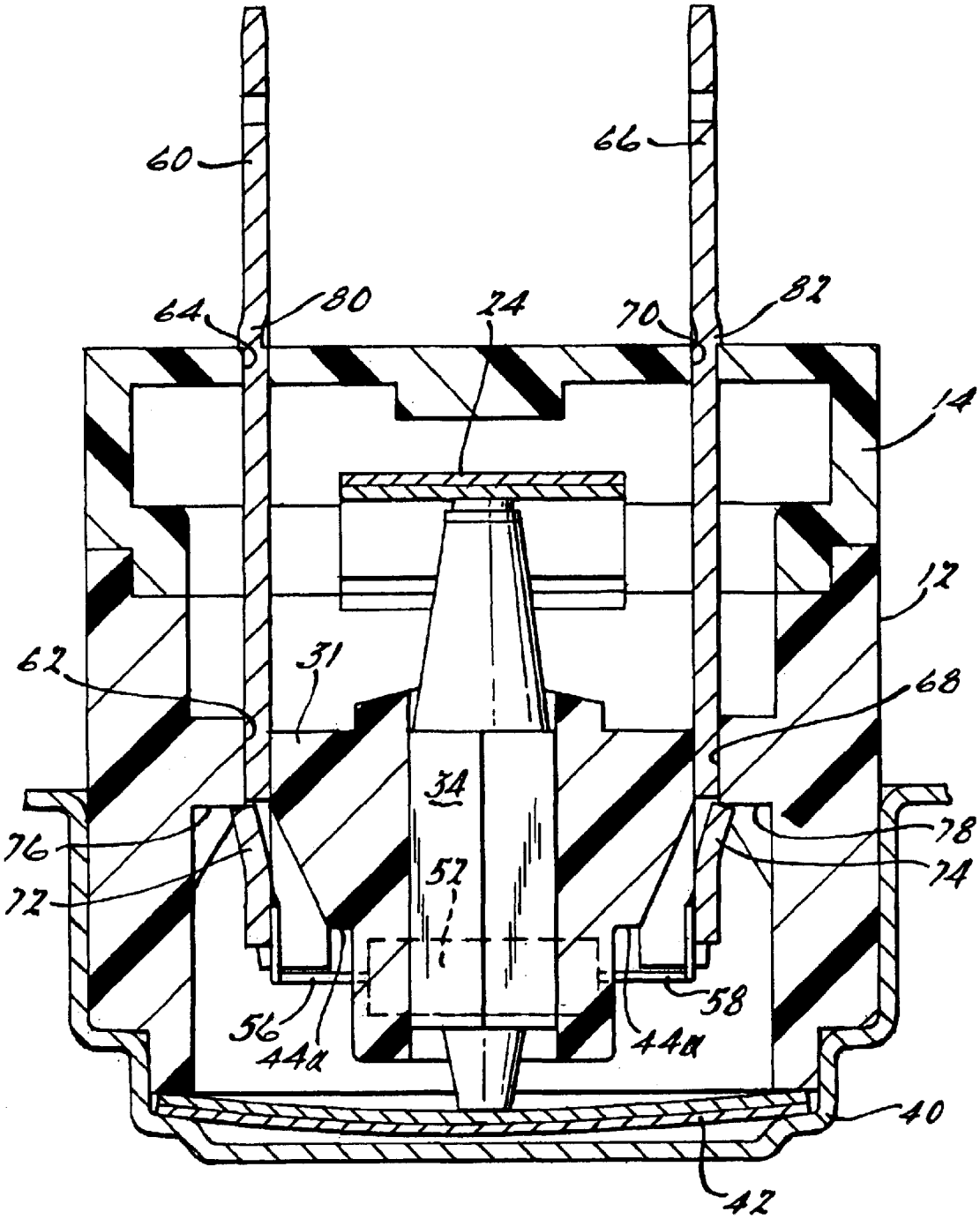
FIG. 4 is a section view of the assembled bimetal snap disc thermostat of FIG. 1, the section being taken along line 4—4 thereof.

Referring now to FIGS. 1 and 4, a resistor heating assembly 50 is provided which comprises a pair of heating resistor elements 52 and 54 each of which includes a pair of leads 56, 58 extending outwardly from opposite ends thereof. Each of the leads 56 are connected to an electrical terminal 60 that extends upwardly from chamber 36 through slotted opening 62 provided in housing 12 and outwardly through a correspondingly aligned opening 64 in cover 14. Similarly, each of leads 58 are connected to terminal 66 which extends upwardly from chamber 36 through slotted opening 68 provided in housing 12 and outwardly through correspondingly aligned opening 70 in cover 14. As such, heating resistors 52 and 54 are electrically connected in parallel across terminals 60 and 66.

Terminals 60 and 66 each include a tang 72, 74 projecting laterally outwardly therefrom which are designed to engage respective flat surfaces 76, 78 provided on housing 12 to limit movement thereof through slots 62 and 68. Similarly, in order to retain terminals in assembled relationship as well as to aid in retaining cover member 14 in assembled relationship to housing 12, the upper ends (as shown) of terminals 60 and 62 each include a staked projection 80, 82 which engages the outer surface of cover 14.

As best seen with reference to FIG. 4, projections 72 and 74 are positioned with respect to leads 56 and 58 such that both leads 56 and 58 as well as resistors 52 and 54 are supported or suspended in spaced relationship to housing 12 and in close proximity to but spaced from bimetal disc 42. Preferably, leads 56 and 58 will be secured to respective terminals 60 and 66 to form a heater subassembly which will then be assembled to housing base 12.

Referring again to FIG. 2, the center portion of sidewalls 46 and 48 of bridge portion 44 are inclined or sloped radially outwardly toward slots 62 and 68. Additionally, a pair of radially outer inclined wall portions 84, 86 and 88, 90 are provided adjacent opposite sides of flats 76 and 78 respectively which slope toward slots 62 and 68 and additional pairs of inclined surfaces 92, 94 and 96, 98 are provided sloping toward opposite ends of slots 62 and 68. These inclined surfaces operate to guide respective terminals 60 and 66 into slots 62 and 68 during the assembly process.

Housing 12 also includes a plurality of four upstanding generally triangularly shaped post portions 100, 102, 104 and 106 which extend upwardly form the surface of bridge portion 44 and serve to reinforce the outer periphery 38 of housing 12 as well as to act as locating surfaces to assist in assuring accurate positioning of leads 56 and 58 and heating resistors 52 and 54 in spaced relationship to housing 12.

Although many different materials may be used for the thermostat housing, in a preferred application, the thermostat housing will be of a phenolic plastic material having a thermal limit of about 350° F. Heaters 52, 54 may have lower heat output than previous arrangements.

Preferably resistance heaters 52 and 54 will be positioned within chamber 36 such that they are spaced from bimetal snap disc 42 a distance of about 0.062" when snap disc is in an activated position (i.e., it has deformed such that the concave portion is facing toward metal cup 40). This assures excellent heat transfer to the bimetal snap disc while still assuring adequate spacing to avoid shorting of the resistor to the bimetal snap disc and avoids the need for an electrically insulating film therebetween which film will impede the rate of heat transfer. While the preferred spacing for heaters 52 and 54 is 0.062" to maximize heat transfer efficiency, they may be positioned up to as much as 0.082" with only a small reduction in the heating efficiency. It is also preferred that the heating resistor bodies be spaced at least 0.015" from the housing body.

It has been found that by reducing the volume of chamber 36 by the inclusion of bridge portion 44 and posts 100, 102, 104, 106 together with positioning the heating resistors in close proximity to the bimetal snap disc without incorporating an insulating film layer has enabled temperature depressions of at least 40° F. or greater to be achieved while utilizing lower wattage heating resistors than had been previously required to achieve such temperature depressions in thermostats using high temperature ceramic housings without exceeding the thermal limit of the phenolic housing. Additionally, the bridge section 44 in combination with posts 100, 102, 104, 106 provide greater reinforcement to peripheral wall 38 thus reducing the possibility of housing 12 being damaged during crimping of outer metal disc 40 thereto. Also, the provision of the inclined sidewalls adjacent slots 62 and 68 greatly facilitates assembly of the heater resistor terminal subassembly by serving as guides for the leading sides of terminals 60 and 62 thus facilitating automated assembly of the thermostat.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

What is claimed is:

1. A bimetal snap disc thermostat comprising:

a phenolic body assembly having a predetermined thermal limit;

a switch in said body assembly;

a bimetal snap disc mounted on said body assembly;

an operator operating said switch in response to snap movement of said bimetal snap disc;

said snap disc and said body together defining a heater chamber;

a pair of heater terminals extending outwardly from said heater chamber through apertures provided in said body assembly, said apertures including at least one tapered surface operable to facilitate insertion of said heater terminals into said body assembly; and at least one resistance heater within said heater chamber in a closely spaced proximity to said snap disc, said at least one resistance heater fixed to said heater terminals by a plurality of leads;

said heater terminals engaging said body to position said at least one resistance heater relative to said snap disc.

2. A bimetal snap disc thermostat as set forth in claim 1 wherein said operator is movably supported by a partition.

3. A bimetal snap disc thermostat as set forth in claim 2 wherein said partition comprises a surface operative to reduce the volume of said heater chamber.

4. A bimetal snap disc thermostat as set forth in claim 1 wherein said thermostat includes a second resistance heater spaced from said at least one resistance heater, said second resistance heater having a pair of leads secured to respective ones of said terminals.

5. A bimetal snap disc thermostat as set forth in claim 1 wherein said resistance heater is insulated from said body assembly and said snap disc only by air within said heater chamber.

6. A bimetal snap disc thermostat as set forth in claim 1 wherein said at least one resistance heater is supported within about 0.082" to 0.062" from said bimetal snap disc.

7. A bimetal snap disc thermostat as set forth in claim 6 wherein the minimum spacing between said resistance heater and said body is 0.015".

8. A thermostat comprising:

a body having a plurality of apertures, at least one aperture including at least one tapered surface;

a switch in said body;

a bimetal snap disc adjacent to said body;

an operator acting on said switch in response to movement of said bimetal snap disc;

said body and said bimetal snap disc cooperating to define a chamber;

a plurality of terminals extending outwardly from said chamber through said apertures in said body;

a plurality of resistance heaters connected to said terminals and located within said chamber; and said terminals including at least one projection engaging said body to support said resistance heaters at a spaced distance from said bimetal snap disc.

9. A thermostat as set forth in claim 8 wherein said chamber contains air, said air occupying the entire space between said resistance heaters and said bimetal snap disc.

10. A thermostat as set forth in claim 9 wherein said resistance heaters are positioned about 0.082 inches to about 0.062 inches away from said bimetal snap disc.

11. A thermostat as set forth in claim 10 wherein said resistance heaters are positioned on opposite sides of said operator.

* * * * *